US006033326A

United States Patent [19]

Lee

[11] Patent Number: 6,033,326

[45] **Date of Patent: *Mar. 7, 2000**

[54] HOCKEY STICK WITH REPLACEABLE BLADE EDGE

[75] Inventor: Richard Lee, Los Angeles, Calif.

[73] Assignee: Richard M. Lee, Los Angeles, Calif.

[ * ] Notice: This patent is subject to a terminal disclaimer.

[21] Appl. No.: 08/410,702

[22] Filed: Mar. 27, 1995

[51] Int. Cl.[7] ..... A63B 59/14

[52] U.S. Cl. ..... 473/560

[58] Field of Search ..... 273/67 A, 171, 273/194 B, 67 R, 173, 174

[56] References Cited

U.S. PATENT DOCUMENTS

| | | | |
|---|---|---|---|
| 2,328,583 | 9/1943 | Reach | 273/171 |
| 3,220,733 | 11/1965 | Saleeby | 273/171 |
| 3,377,065 | 4/1968 | White | 273/67 A |
| 3,529,825 | 9/1970 | White, Sr. . | |
| 3,982,760 | 9/1976 | Tiitola | 273/67 A |
| 4,651,990 | 3/1987 | Profit . | |
| 4,699,383 | 10/1987 | Kobayashi | 273/173 |
| 5,230,509 | 7/1993 | Chavez | 273/171 |
| 5,294,113 | 3/1994 | Ladouceur et al. . | |

FOREIGN PATENT DOCUMENTS

| | | | |
|---|---|---|---|
| 755982 | 4/1967 | Canada | 273/67 A |
| 846673 | 8/1960 | United Kingdom | 273/67 A |

*Primary Examiner*—Theatrice Brown
*Attorney, Agent, or Firm*—Workman, Nydegger & Seeley

[57] ABSTRACT

A durable replaceable blade edge for a hockey type stick wherein the replaceable blade edge includes a narrow rectangular strip on the bottom edge of the hockey stick blade. In one form of the invention, the replaceable edge includes an elongated dovetail shaped mortise which is structured for interlocking attachment to an elongated dovetail shaped tenon on the bottom surface of a modified hockey stick blade. One end of the replaceable edge is structured for bolt on securement to the blade which allows for quick and easy affixment and replacement of a worn edge. A second form of the invention is provided as an accessory glue-on member to the blade bottom of an existing standard hockey stick. The glue-on blade edge preferably includes a plurality of angular grooves into and around which liquid adhesive flows and then hardens to interlock with the blade edge.

8 Claims, 8 Drawing Sheets

HOCKEY STICK WITH REPLACEABLE BLADE EDGE

BACKGROUND OF THE INVENTION

1. Field of the Invention

This invention relates to a hockey stick which is primarily used for playing a variation on the game of ice hockey wherein a ball is generally substituted for the hockey puck, and the game is played on asphalt or cement instead of ice.

2. Description of the Prior Art

It has become increasingly popular for people to play what is referred to as ball hockey or roller hockey on paved surfaces, using roller skates or roller blades and a ball or a rolling puck. Conventional hockey sticks are used for this game, and while ice hockey stick blades experience edge wear during use on ice, the wear is much more pronounced when the stick is used on cement or asphalt. The lower bottom edge of the blade of the hockey stick receives the major portion of the wear due to being slid across the asphalt or cement during play. Extended use can cause splitting and cracking of wooden, plastic or fiberglass blades, and actually wears away such a significant portion of the blades that they eventually become useless.

Prior art devices have been provided which are related to the present invention. One such device, a protective device for goaltender hockey sticks, was patented by G. Profit on Mar. 24, 1987, U.S. Pat. No. 4,651,990. Profit's device includes a detachable U-shaped thin plastic panel which is wrapped around and taped to the hockey blade. Profit's device is directed for use with goaltender hockey sticks which are slightly different than regular hockey sticks. Profit's panel extends a significant distance up both sides of the blade and becomes the surface which contacts the ball. Any irregularities in the surface of the panel or the taping thereof could possibly adversely deflect the ball when it is struck. This device also adds significant bulk and possibly weight to the blade which may be undesirable, and the taping procedure is also time consuming.

A hockey stick road adapter, U.S. Pat. No. 3,529,825, was patented by White, Sr. on Sep. 22, 1970. The adapter includes a removable metal or plastic strip affixed with a series of ball bearings which is attached to the bottom edge of the blade. The ball bearing strip serves to reduce the friction on the hockey blade edge when used on paved surfaces. One disadvantage of the White device is that even though White suggests ways to wash or clean the bearings, dirt can still get into and around the bearings and adversely effect their function. Therefore excess time would be required cleaning this device after each use. It also appears the White device is not readily replaceable. In addition, metal bearings do not roll smoothly on asphalt and create excessive vibration which is distracting for the player.

Another hockey stick protector was patented by Ladouceur et al, on Mar. 15, 1994, U.S. Pat. No. 5,294,113. This protector device includes one or two narrow pieces of U-shaped plastic channels which are applied to the front or back section of the blade edge on specific areas which receive the most wear. The channels are taped in the respective locations and can be removed for using the hockey blade on ice. Again, excess time is required to tape this device onto a hockey blade and although the side edges of the channels are short, they still provide an edge which may adversely deflect the ball in an undesirable direction. The tape used to secure several of the prior art removable protective devices is not believed sufficiently durable.

Therefore, it would be an improvement to provide a hockey stick blade protector which was small and light in weight, would be quick and easy to attach and remove, would not interfere with the striking action of the ball or puck, and would be inexpensive.

SUMMARY OF THE INVENTION

The present invention in one form provides a modified hockey stick blade structured for removable affixment with a protective replacement edge for the bottom surface of the blade. The replacement edge includes a rectangular elongated narrow strip of plastics which is highly abrasion resistant. The replacement edge is preferably about equal to the thickness of the hockey blade and structured to conform to the lateral and horizontal curvature of the blade. The height of the replacement edge can vary, but is normally adequate at around one-half inch from the bottom upward to the bottom of the hockey blade. The top lengthwise surface of the replacement edge has a dovetail groove or mortise adapted for slide on interconnecting or interlocking attachment over a dovetail tenon formed lengthwise into the center bottom surface edge of the hockey blade. The end of the replacement edge positioned adjacent the heel area of the blade is slightly enlarged in height and contains a rectangular mortise having a bolt aperture therethrough. The corresponding area on the hockey blade is recessed on both sides to accommodate the enlarged area of the strip and is also formed into a narrow tenon to interconnect with the corresponding mortise of the replaceable strip. The narrow tenon of the blade also contains a bolt aperture therethrough which aligns with the bolt aperture on the replacement edge. A small nut and bolt are used to help retain the strip in position once it is slid into place on the hockey stick blade. The bolt head and nut are preferably recessed into the sides of the strip to eliminate any projecting members which might adversely deflect the ball or puck, or get caught on clothing. The dovetail joint prevents slipping of the protective edge upwards or downwards, and the securement with the nut and bolt prevents horizontal displacement.

The protective edge is readily replaceable due to the removable nut and bolt arrangement in combination with the mortise and tenon. There are also no lateral projecting members to interfere with the striking of the ball. The replaceable edge is also light in weight. The plastics material of which the protective edge is manufactured has a low frictional quality which allows the hockey blade to actually slide easier over the pavement than the original material of which most hockey stick blades are manufactured. The replaceable protective edge is well suited for use on ice or any playing surface. The preferred material of which the replaceable protective edge is manufactured has been found to reduce the noise of the blade dragging across the asphalt. Since the protective edge is comprised of one relatively small piece of plastics material, it is also inexpensive to produce, thereby being inexpensive for the consumer to purchase. Extra replacement edges can be purchased separately from the modified hockey stick blades as needed, which helps save the consumer money. The modified blades having the tenon can also be provided with or without the handles, or they could be provided with an integrally molded handle. Since the replaceable protective blade edges are slightly flexible, they can be bent to adapt to left or right handed blades which are curved in opposite directions. Therefore, the replacement edges can be provided in one straight embodiment which is less expensive to manufacture due to reduced tooling requirements.

In a second form of the invention, the replaceable protective blade edge for the bottom of the hockey stick blade is provided absent the mortise, and is glueable to the bottom edge of a standard or conventional hockey stick blade which does not include a tenon as with the first form of the invention. This glue-on replaceable protective blade edge is made of durable plastics which are sufficiently flexible to allow the plastic replacement edge to be bent to conform to left or right hand hockey stick blades. This glue-on form of the replacement edge may be removed when the edge is badly worn, and a new glue-on blade applied. Since my glue-on blade edge does not require a modified hockey stick blade, being attachable to existing standard blades which do not include tenons on the bottom edge, the glue-on replacement edge is believed to be a very inexpensive solution to the problem of blade edge wear.

Other objects and advantages of this invention will become apparent to those skilled in the art with examination of the remaining specification, claims and accompanying numbered drawings.

DESCRIPTION OF THE PREFERRED EMBODIMENTS

Figure 1:
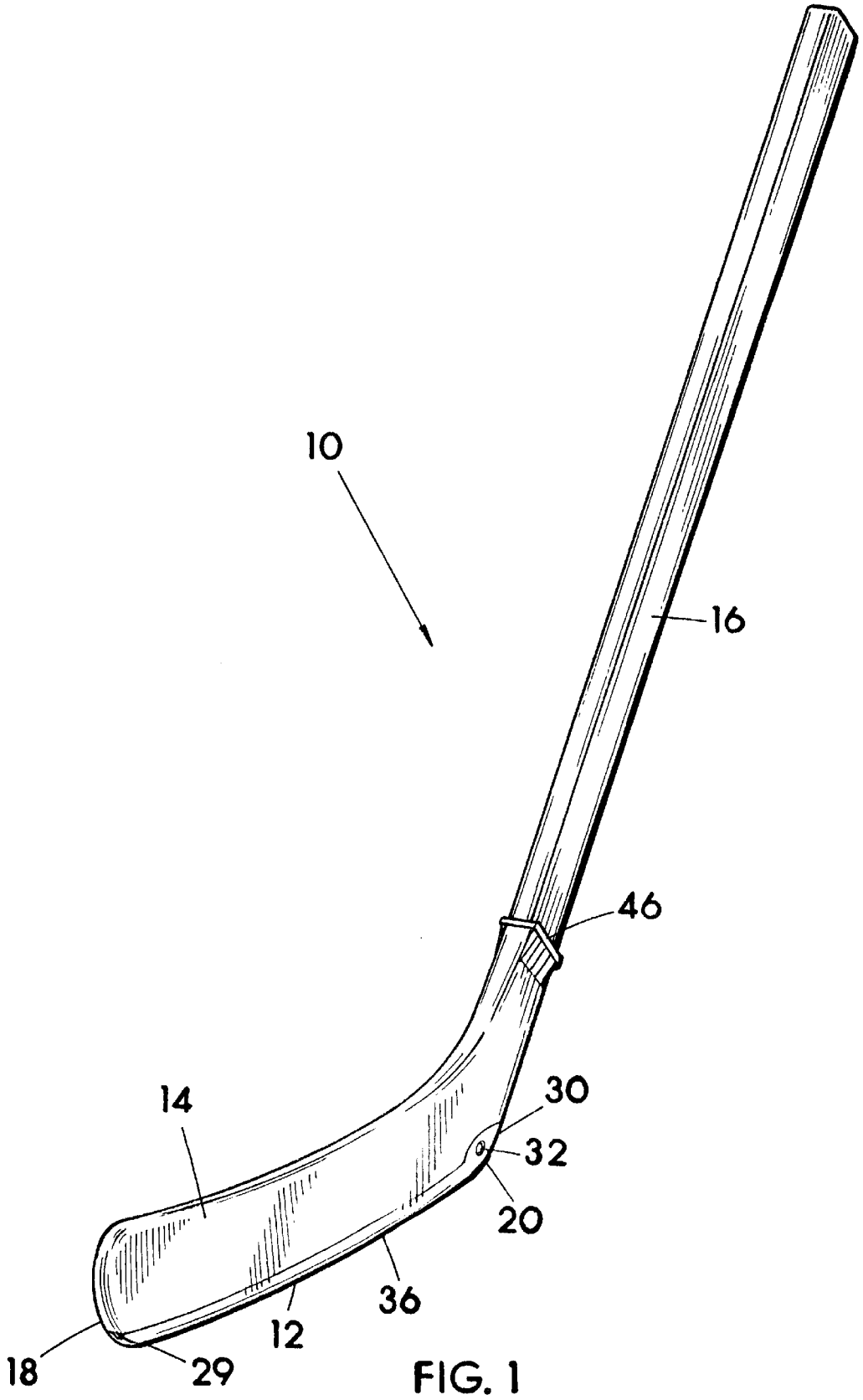
FIG. 1 is a front perspective view of a left hand hockey stick with the mortise and tenon replaceable blade edge affixed in place on the modified blade.
Figure 2:
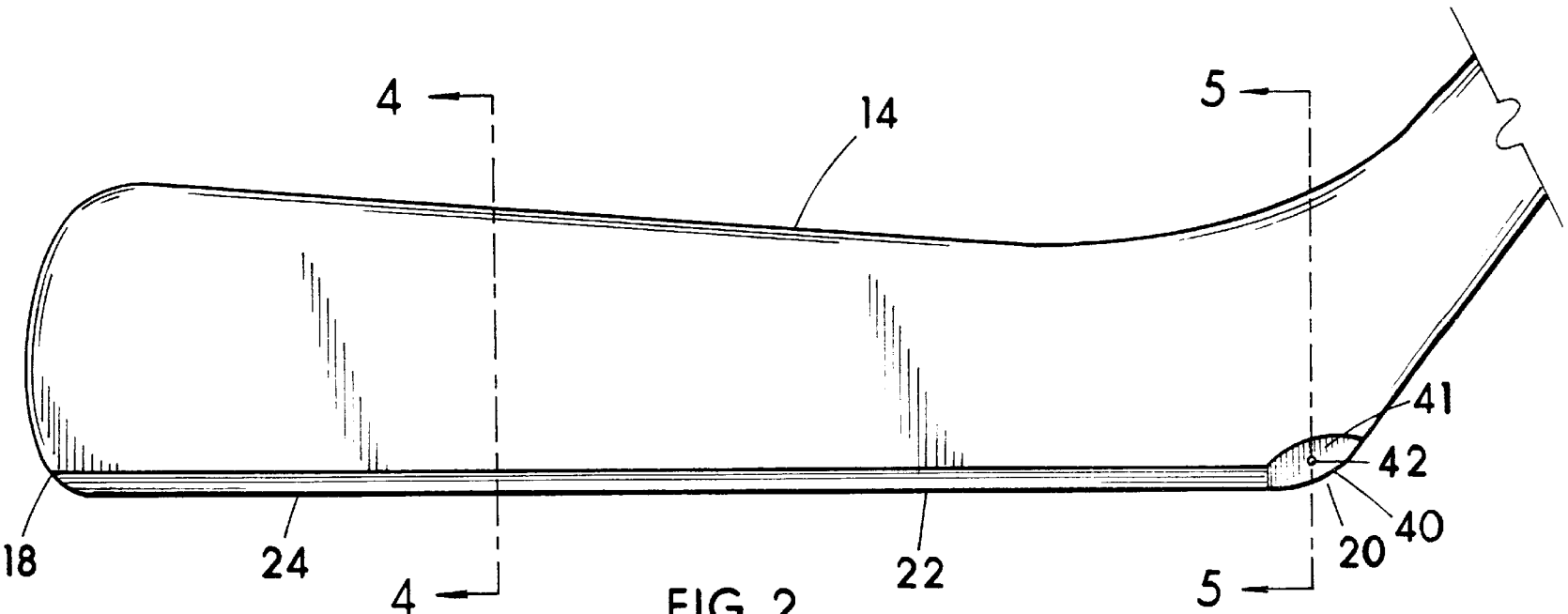
FIG. 2 is a left side view of the modified blade portion of the hockey stick with the replaceable blade edge removed to show the tenon.
Figure 3:
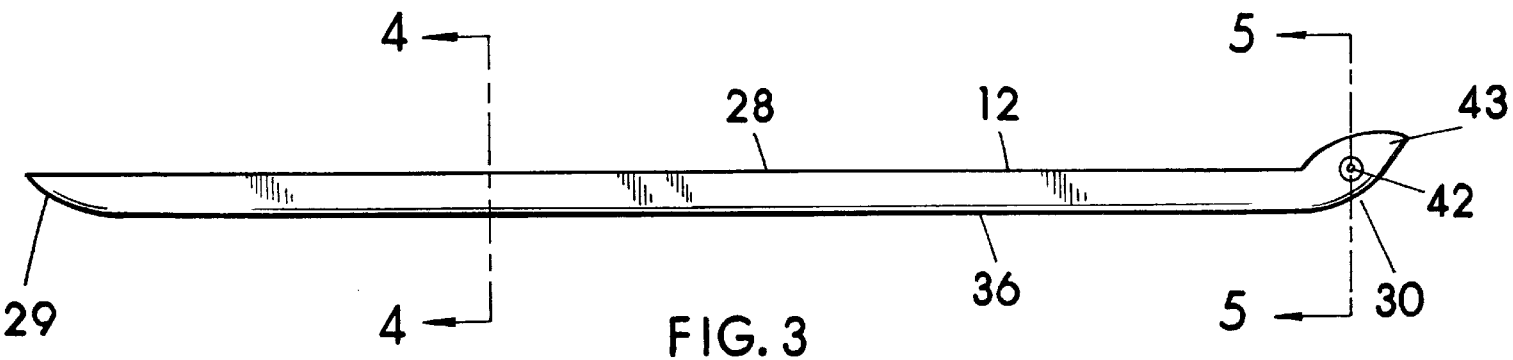
FIG. 3 is a left side view of the replaceable blade edge having the mortise.
Figure 4:
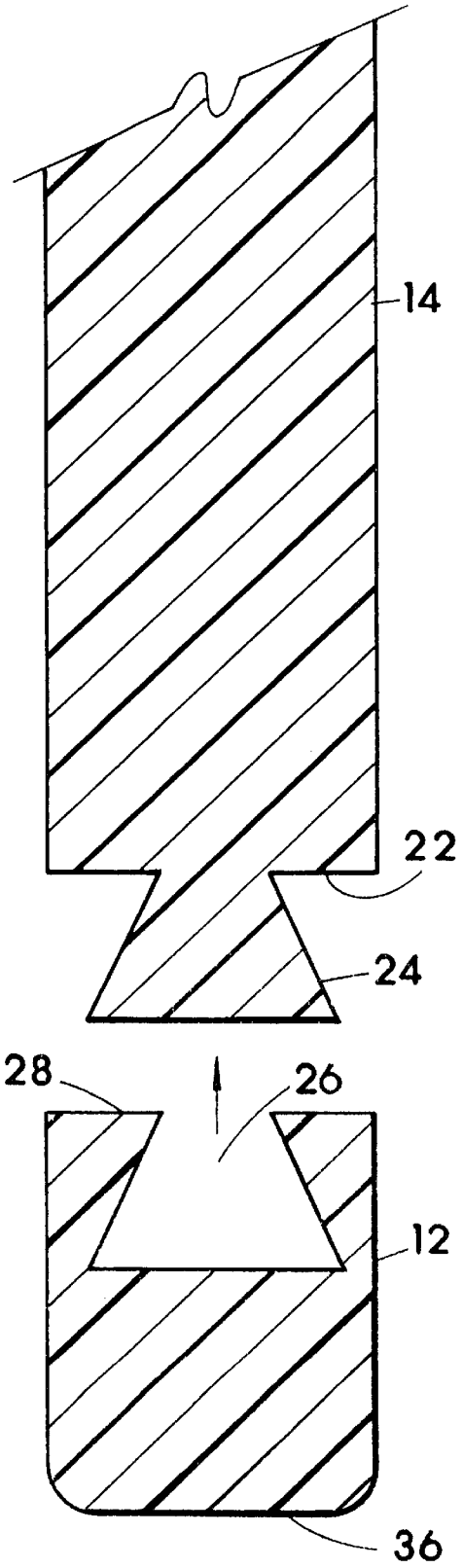
FIG. 4 is an enlarged cross sectional view of the bottom edge of the midsection of the blade (taken at 4 of FIG. 2), showing the dovetail tenon, and below it the replaceable blade edge (taken at 4 of FIG. 3), showing the dovetail mortise.
Figure 5:
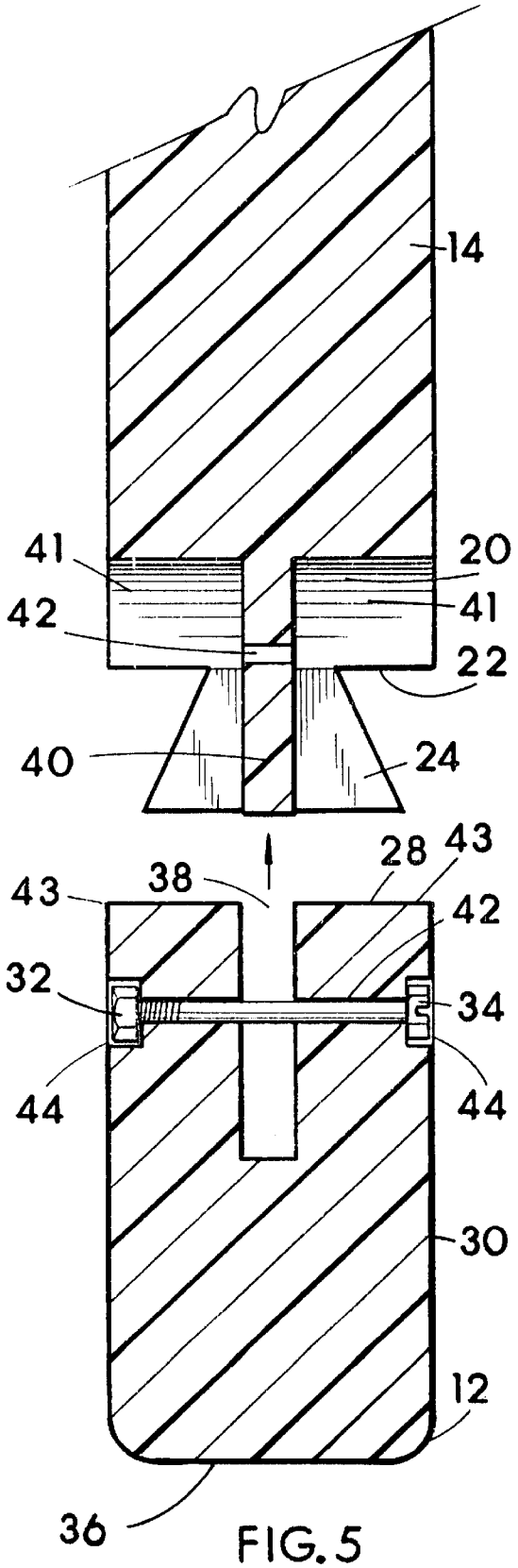
FIG. 5 is an enlarged cross sectional view of the bottom edge of the heel section of the blade (taken at 5 of FIG. 2), showing the tenon section for the bolting arrangement, and below it the replaceable blade edge (taken at 5 of FIG. 3), showing the rectangular mortise section and the nut and bolt which are shown recessed into the replaceable blade edge for illustrative purposes.
Figures 6, 7:
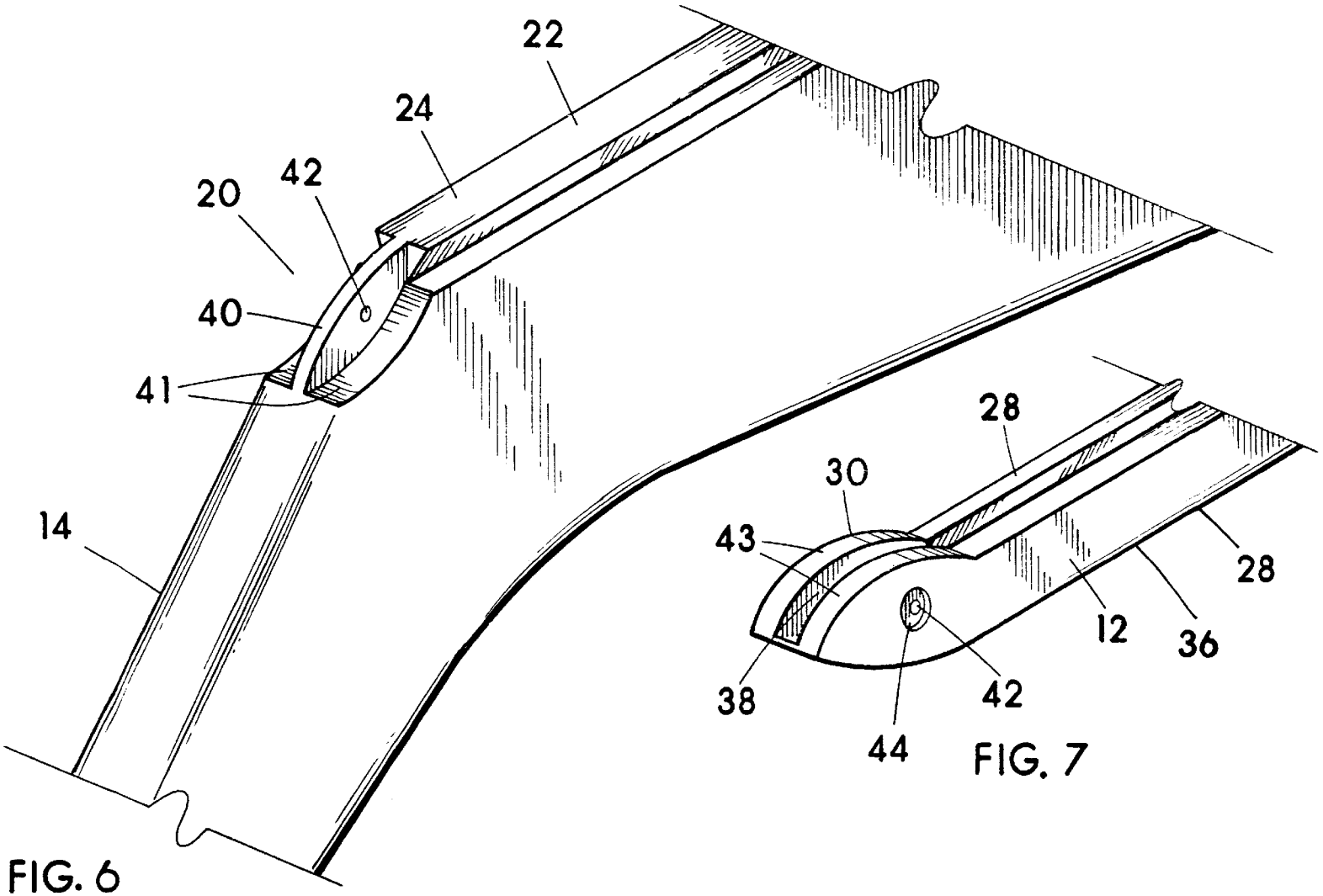
FIG. 6 is a perspective partial view of the heel portion of the modified blade with the blade edge removed to show the dovetail tenon and the rectangular tenon at the end of the dovetail tenon for securement of the blade edge with a nut and bolt.
FIG. 7 is a perspective bottom view of the end portion of the removable blade edge showing the dovetail mortise and the regular mortise which is adapted for bolt on attachment to the blade.

Referring now to the drawings where hockey stick 10 with replacement edge 12 for the modified blade 14 is illustrated. Hockey stick 10 basically includes an elongated handle 16 and a slightly curved thin L-shaped blade 14, which can be removably or permanently affixed to the handle 16 at area 46. Blades 14 are provided in left or right hand models, with the left hand model curving slightly to the right and the right hand model curving to the left. Handle 16 can be manufactured of wood or plastic, with blade 14 preferably manufactured of a tough durable shock resistance plastic or wood. Blade 14 is roughly L-shaped with the distal tip referred to as the toe 18 and the curved area adjacent the handle 16 referred to as the heel 20. The bottom surface 22 of blade 14 is approximately five-eights of an inch in thickness at the widest end or heel 20, and narrows to around one-quarter of an inch towards the toe 18. The entire lengthwise bottom surface 22 of the modified blade 14 is formed into a centrally positioned elongated dovetail tenon 24 which is adapted for slide over interlocking attachment to a corresponding dovetail mortise 26 incorporated into the top surface 28 of replacement edge 12, which will be described later. Both sides of the heel 20 of blade 14 are incorporated with semi-circular recesses 41 which create a single central rectangular shaped tenon 40. Semi-circular recesses 41 and tenon 40 are adapted along with dovetail tenon 24 for slide on attachment of replacement edge 12 onto bottom surface 22 of the modified blade 14.

Replacement edge 12 is basically an elongated rectangular strip of friction resistant semi-flexible plastics material, such as a highly abrasion resistant polyethylene which actually allows easier sliding of blade 14 over paved surfaces, such as asphalt and concrete. The plastics material which I prefer from which to manufacture my replaceable blade edges is UHMW which stands for ultra high molecular weight polyethylene. Other plastics could be used, but UHMW is economical, durable, highly resistant to abrasive wear, can be mixed with lubricants to make it slick and further resistant to abrasive wear, is slightly flexible, and is a thermoplastic which can be injection molded for inexpensive shaping. UHMW is however extremely difficult if not impossible to get glues and adhesives to stick thereto, and this aspect will be further addressed later.

Replacement edge 12 has a lengthwise top surface 28 and an oppositely disposed bottom surface 36, a front end 29 and an oppositely disposed back or terminal end 30. Replacement edge 12 is the about same width as blade 14, being slightly narrower at front end 29 and widening to terminal end 30. The top surface 28 is incorporated with a centered dovetail mortise 26 which extends from front end 29 to adjacent the terminal end 30, and is sized and shaped for slide in interlocking attachment over dovetail tenon 24 of blade 14. The terminal end 30 of replacement edge 12, which is positioned over the heel 20 of blade 14 when in use, is modified into a slightly enlarged disc-shaped area which corresponds to the semi-circular recesses 41 of blade 14. Top surface 28 of terminal end 30 of replacement edge 12 contains a central rectangular mortise 38 which is adapted for interlocking attachment to the central rectangular tenon 40 located on the heel 20 of blade 14. The two disc-shaped projections on terminal end 30 of replacement edge 12 on either side of mortise 38 are referred to as semi-circular extensions 43. Both the rectangular tenon 40 of blade 14 and the two semi-circular extensions 43 of replacement edge 12 are incorporated with bolt apertures 42 which align with one another when in use. The open ends of the bolt aperture 42 in semi-circular extensions 43 on replacement edge 12 are enlarged and form recessed openings 44 to allow for counter sinking of nut 32 and the head of bolt 34 below the surface of replacement edge 12. The recessed opening 44 receiving nut 32 is preferably hexagonal in shape and is slightly larger than nut 32 in order to prevent rotation of nut 32 during engagement with the threaded portion of bolt 34, thus eliminating the need of a nut holding wrench.

Replacement edge 12 is preferably manufactured in a single relatively straight embodiment instead of being provided in two separate curved embodiments which match the curvature of the left and right handed blades 14, to reduce manufacturing and handling costs. Since replacement edge 12 is slightly flexible it can be easily bent laterally to accommodate the curvature of both left and right handed blades 14. The natural biasing of replacement edge 12 which attempts to return it to a straight position, also helps to provide a type of clamping pressure, or snug fit, which further helps retain replacement edge 12 onto blade 14.

To attach replacement edge 12 onto blade 14, blade 14 is preferably positioned upside down with bottom surface 22 facing upward. The heel 20 end of blade 14 is positioned facing the front end 29 of replacement edge 12. The top surface 28 of replacement edge 12 is positioned downward, and dovetail mortise 26 of replacement edge 12 is slidably inserted over the dovetail tenon 24 of blade 14. When the front end 29 of replacement edge 12 almost reaches toe 18 of blade 14, rectangular tenon 40 of blade 14 will begin insertion into rectangular mortise 38 on replacement edge 12. When replacement edge 12 is fully inserted over bottom surface 22 of blade, bolt 34 is then inserted through the aligned apertures 42 of both semi-circular extensions 43 and rectangular tenon 40. The terminal end of bolt 34 is affixed with nut 32 which has been inserted into the appropriate recessed opening 44 on semi-circular extensions 43. The head of bolt 34 is slotted and can be rotated with a small conventional screw driver. Nut 32 will not rotate since the corresponding recessed opening 44 into which nut 32 is inserted is octagon in shape. Once affixed, replacement edge 12 is securely attached to blade 14 and can not be knocked or pulled off with regular use. To remove or replace replacement edge 12, the procedure is simply reversed.

Figure 8:
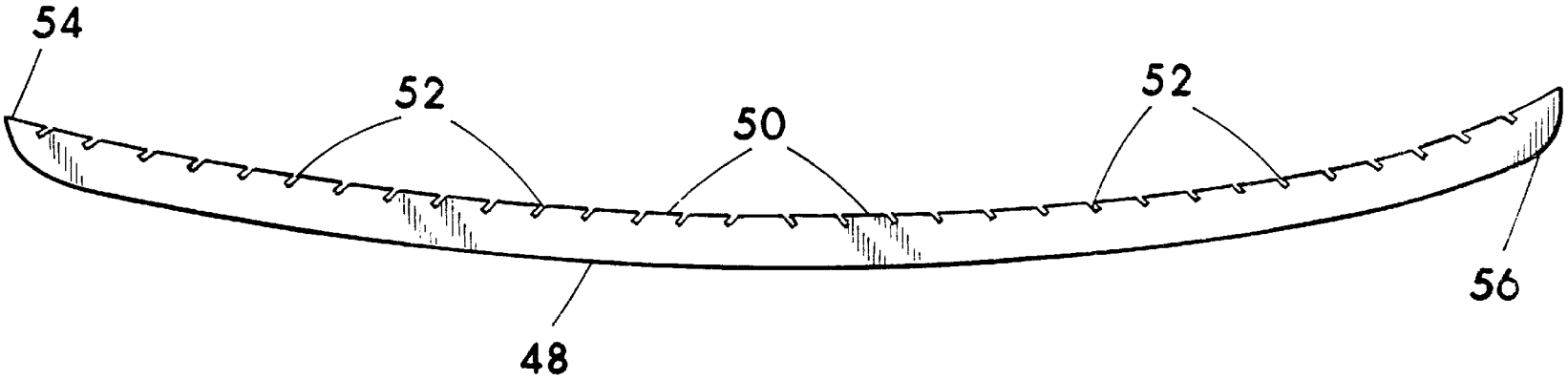
FIG. 8 is of the second embodiment or form of the invention showing a glue-on blade edge from the side, and showing sloped or angled transverse cuts in the surface to abut the bottom of the hockey stick blade.
Figure 9:
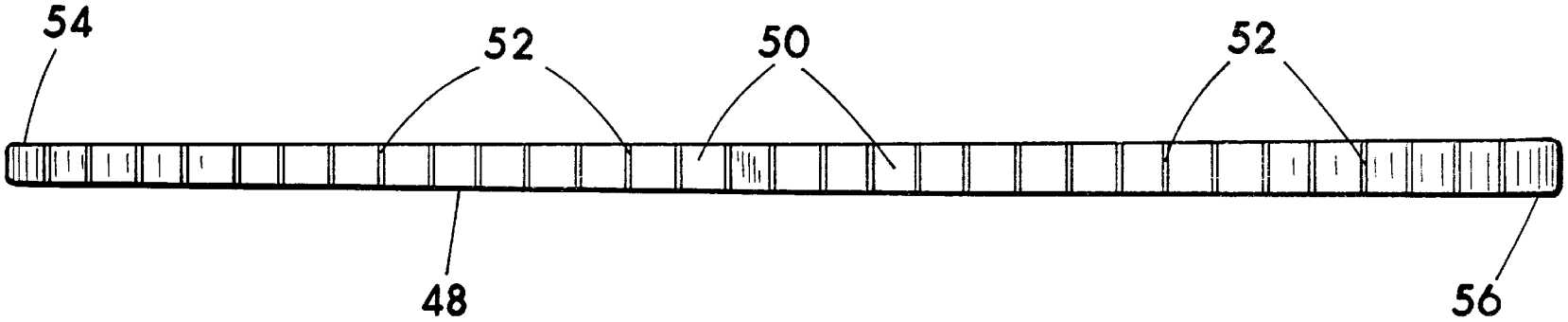
FIG. 9 is a top plan view of that shown in FIG. 8.
Figure 10:
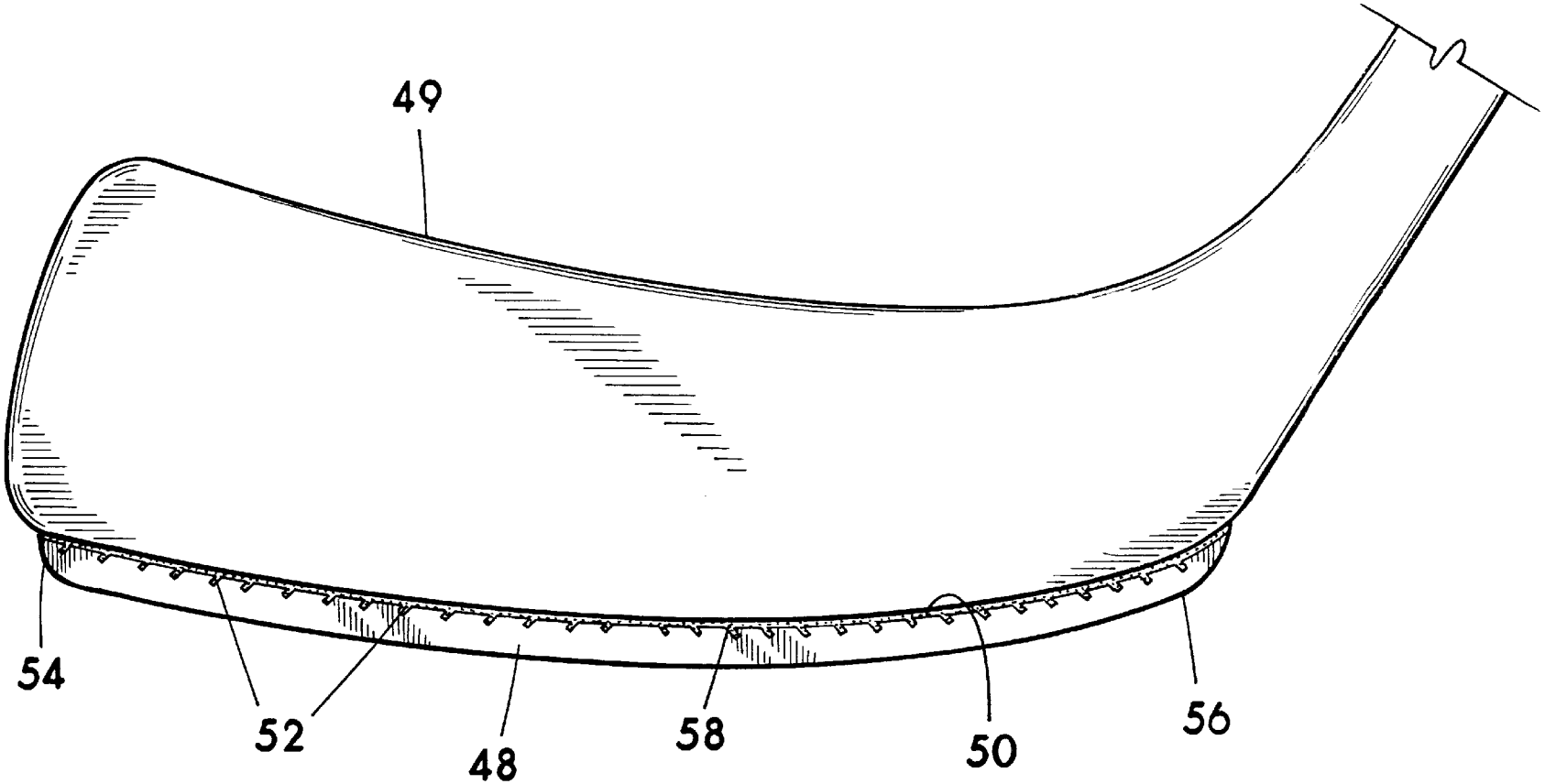
FIG. 10 is an in use illustration of the glue-on embodiment of the blade edge of FIGS. 8–9 adhesively affixed to the bottom edge of a conventional hockey stick.

As previously stated, the plastics material which I prefer from which to manufacture my replaceable blade edges is UHMW. Other plastics such as polypropylene for example could be used, but UHMW is what I prefer. UHMW is however extremely difficult if not impossible to get glues and adhesives to stick thereto, which has been taken into account in the second form of the invention illustrated in a structural embodiment in FIGS. 8–10, and in a slightly varied structural embodiment in FIGS. 11–12. The second form of the invention includes the glued-on replacement edge 48 which is structured for adhesive attachment to the bottom of existing conventional or standard hockey blades 49 which do not include tenons. Standard hockey stick blades are typically made of wood, plastic or fiberglass, and most commonly being made of wood or fiberglass which is easily glued to with available glues. Less commonly found in the market place and in existing use are hockey stick blades made of plastics. The plastics of the less common typical plastic hockey stick blades is believed to be ABS, styrene or some other plastics, but normally being of a type to which common adhesive will adhere based on my experimentation. Glue-on blade edge 48 as shown in FIGS. 8–10 is similar in size and composition to replacement edge 12, except the top surface 50 thereof does not have a dovetail tenon 24 nor a disc-shaped terminal end 30. The top surface 50 of glue-on replacement edge 48 is preferably gently curved to match the curved bottom surface 22 of a standard hockey stick blade 49, and preferably has a series of equidistant shallow angled transverse cuts 52. From the center of replacement edge 48 the cuts 52 are angled forward towards the front tip 54, and the remaining half of cuts 52 are angled toward the back end 56. Cuts 52 provide a certain degree of lengthwise flexibility in replacement edge 48 to help accommodate bottom edge curvatures on various makes and models of existing blades 49, and also for accumulation of a liquid adhesive 58 which will hardened within the cuts 52. Since glue-on replacement edge 48 is both laterally and vertically flexible to a small degree, it can be affixed to both left and right hand existing hockey sticks 10. To affix glue-on replacement edge 48, a relatively large amount adhesive 58 is applied to top surface 50 which is then abutted against the bottom surface of a regular hockey blade 49. Since UHMW is extremely difficult to glue, cuts 52 being angled provide an undercut arrangement wherein when liquid adhesive hardens therein, the blades 49 is mechanically lock or bound to the adhesive due to the multiple angles of cuts 52, and the adhesive will be adhered to the bottom edge to the standard blade. Some form of clamping members may be applied to replacement edge 48 and blade 49 until the adhesive 58 has become hard or semi-hard. Prior to the glue hardening, a scrapping tool or trowel should be used to smooth the lateral side edges so large clumps of the glue do not harden sticking outward beyond the sides of the blade in a manner which might adversely effect the desired direction the ball or puck will travel when struck by the blade. It should be noted however, that due to the diameter of the typical hockey ball that the replaceable blade edge normally does not actually strike the ball, but is typically positioned downward below the major diameter of the ball and the blade itself contacts the ball at its major diameter, this however varies based on each swing at the ball. Replacement edge 48 allows the user to adapt his existing standard hockey blades with a protective edge in a very economical manner. When glue-on edge 48 has become excessively worn from use, prying or the like levered force with a tool such as a straight blade screw driver can be used to remove the worn edge 48 from the blade 49. If preferred, the worn edge 48 may be cramped in a vise, and the blade 49 grasped and forcefully bent back and forth to in essence fatigue the glue to the point of giving way to allow separation of the worn edge 48 from blade 49. Sandpaper or a file should then be used to remove any excessive amount of remaining glue on the bottom of blade 49 prior to gluing on a new replacement edge 48. Alternatively, concrete or asphalt serve as good abrasive surfaces to remove excess glue from the bottom of blade 49, and to use the concrete or asphalt as an abrasive, the hockey stick with the removed edge 48 can be played on a rough surface for a while prior to affixing a new edge 48.

Figure 11:
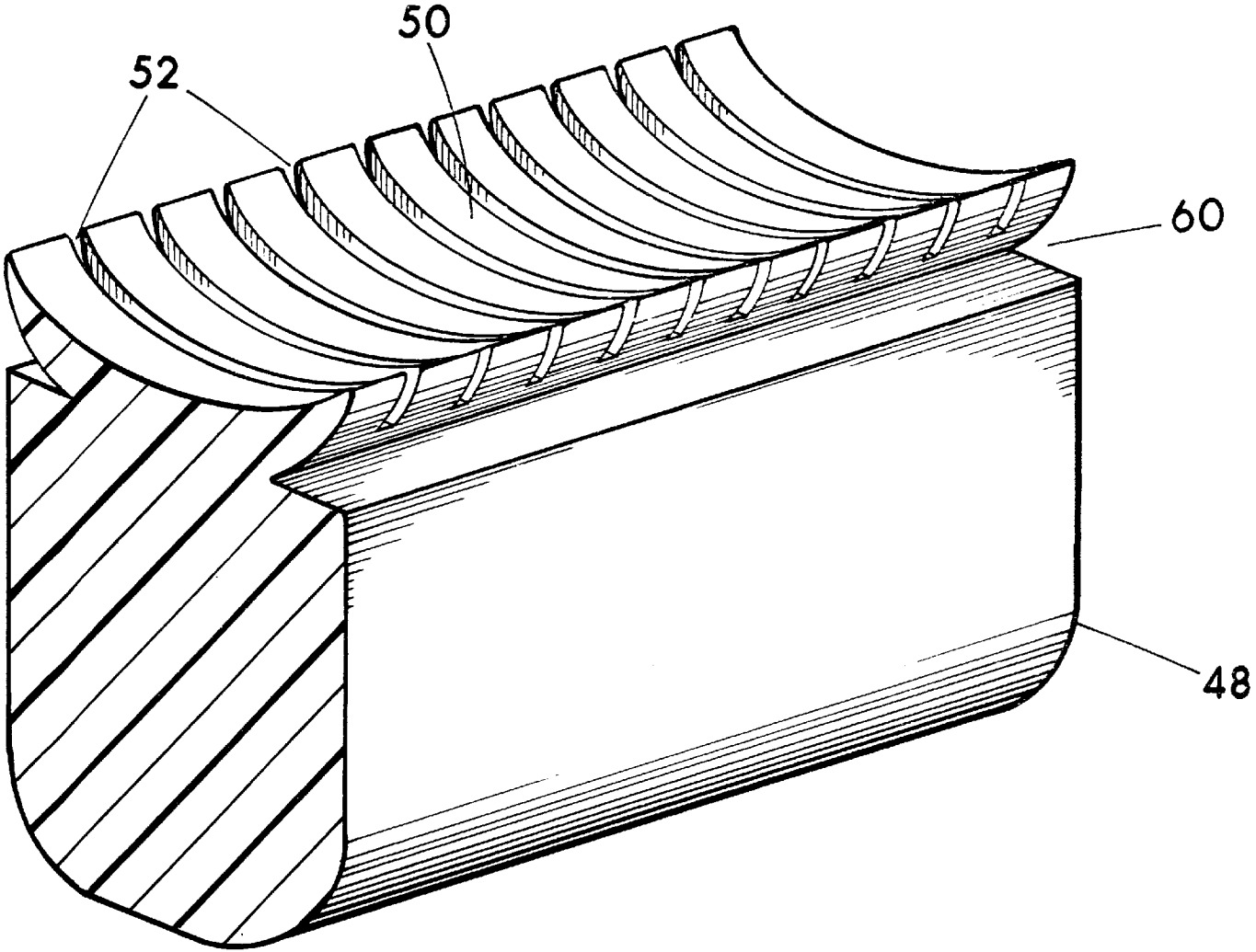
FIG. 11 is a perspective view of a cross section of a portion of a slightly varied embodiment of the glue-on blade edge showing vertical transverse cuts, a curved mating surface to conform to the curved bottom edge of a standard hockey blade, and a lateral or lengthwise groove on each opposite side to the edge extending essentially perpendicular to the transverse cuts. The transverse cuts are shown opening into the lateral grooves, and it can be seen that an undercut is defined by the lateral grooves.
Figure 12:
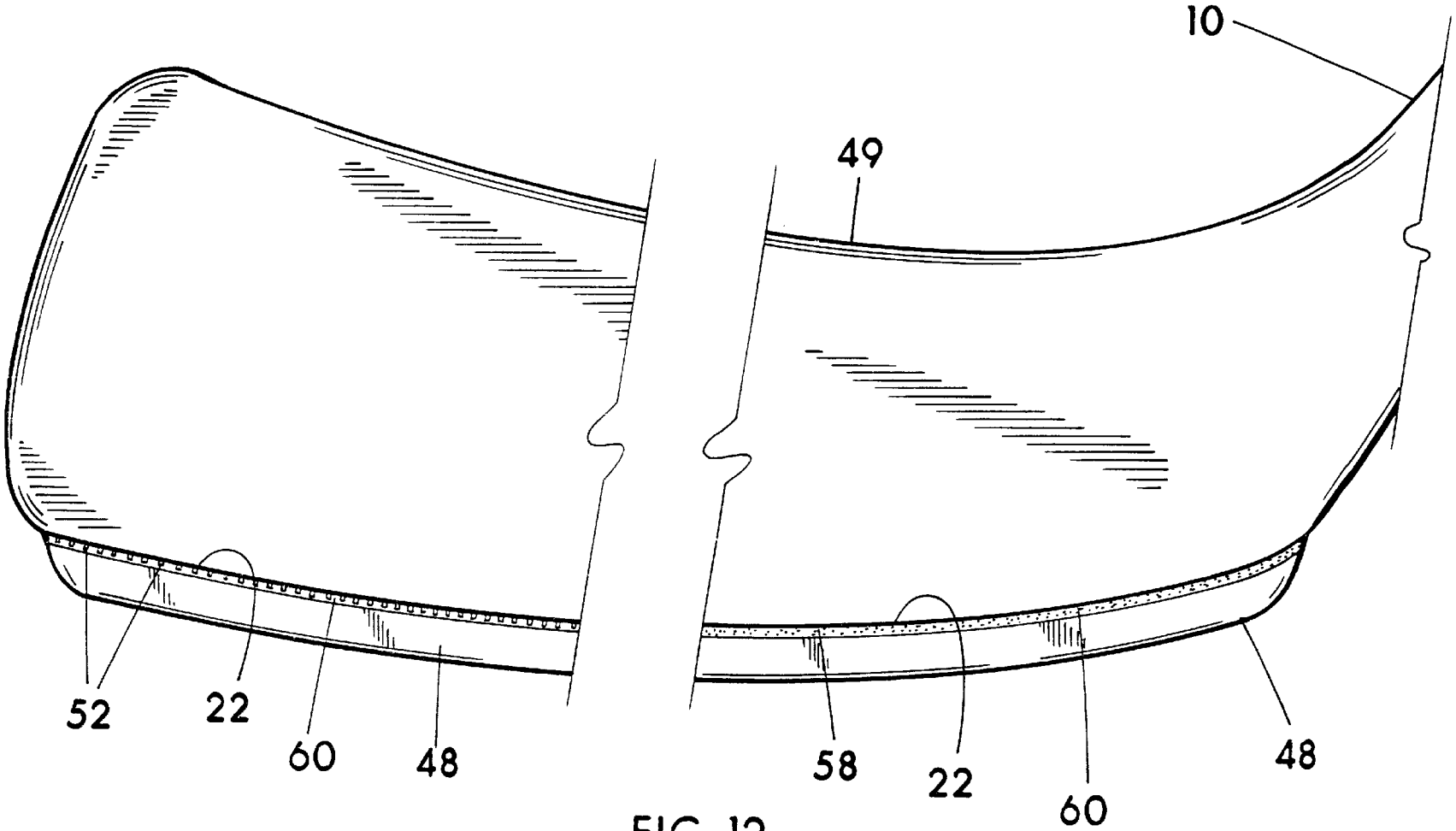
FIG. 12 illustrates a standard hockey blade and the glue-on edge of FIG. 11, affixed to the blade, wherein the left half of the blade is affixed with glue and the right half is left unglued for illustrative purposes. The glue is shown having filled the transverse cuts and lateral or lengthwise groove to form a mechanical lock wherein the glue is not actually adhered or bonded to the replaceable blade edge, but rather has hardened within the transverse grooves and lateral grooves around the undercuts thereof to be mechanically secured from releasing or disengaging from the blade edge. The glue has however adhered or bonded to the bottom side of the standard hockey stick blade which is made of a material different than the replaceable blade edge, and one to which glue will adhere. The blade edge in this embodiment is made of a plastics material to which common known adhesives (glues) will not normally stick, and thus the reasoning for the mechanical locking of the glue over and in the lateral grooves.

A slightly modified version of the second form or glueable replacement edge 48 is provided in a third embodiment shown in FIGS. 11–12, and differs in that top surface 50 is curved to match the curved bottom surface 22 of some makes of blades 49, and the transverse cuts 52 may be straight instead of angled when combined with longitudinal grooves 60 located adjacent either side of top surface 50. Cuts 52 are shown in open communication with the lateral grooves 60. Grooves 60 provide an elongated undercut or overhang in communication with the transverse cuts 52 as shown in FIG. 11, to provide extra gripping surface for adhesive 58 which ensures a better contact with replacement edge 48. FIG. 12 illustrates a standard hockey blade 49 and the glue-on edge of FIG. 11, affixed to the blade 49, wherein the left half of the blade is affixed with glue and the right half is left unglued for illustrative purposes. The glue is shown having filled the transverse cuts and lateral or lengthwise groove to form a mechanical lock wherein the glue is not actually adhered or bonded to the replaceable blade edge, but rather has hardened within the transverse grooves and lateral grooves around the undercuts thereof to be mechanically secured or locked from releasing or disengaging from the blade edge 48. The glue has however adhered or bonded to the bottom side of the standard hockey stick blade which is made of a material different than the replaceable blade edge, and one to which glue will adhere. The blade edge 48 in this embodiment is made of a plastics material to which common known adhesives (glues) will not stick, and thus the reasoning for the mechanical locking of the glue over and in the lateral grooves. Although other glues will function to differing degrees, I prefer or have gotten good results with urethane based glues, but I have also achieved good results with hot melt glues.

Although I have very specifically described the preferred structures and use of the invention, it should be understood that some changes in the specific structures described and shown in my drawings may be made without departing from the true scope of the invention in accordance with the appended claims.

What I claim as my invention is:

1. A hockey stick blade having a replaceable edge secured thereto, comprising:

a longitudinally extending tenon on a bottom surface of the blade;

a narrow elongated replaceable edge having a narrow lengthwise top surface with a longitudinally extending mortise in said top surface which is engaged over said tenon on said bottom surface of said blade; and removable securing means affixing said replaceable edge to said blade with said mortise engaged over said tenon;

said removable securing means being located in a heel section of said replaceable edge and said blade;

whereby said replaceable edge can be removed from said blade and replaced by removal of said securing means, removing said edge, positioning another edge having said mortise positioned over said tenon of said blade, and replacing said securing means.

2. A hockey stick blade having a replaceable edge, comprising:

a hockey stick blade having a bottom surface;

an elongated replaceable edge having a top surface for interfacing said bottom surface of said blade;

mortise and tenon interconnecting means between said bottom surface of said blade and said top surface of said replaceable edge connecting the replaceable edge to said blade; and securing means located in a heel of said replaceable edge and said blade for affixing said replaceable edge to said blade.

3. In a hockey stick having a blade having a lower edge, the improvement comprising:

a replaceable edge for said blade, and means for securing said replaceable edge directly to said blade lower edge.

4. The improvement of claim 3, wherein said securing means is positioned in a heel section of said blade and said replaceable edge.

5. The improvement of claim 3, wherein said securing means extends along mating surfaces of said blade lower edge and said replaceable edge.

6. The improvement of claim 3, wherein said replaceable edge is connected to said blade lower edge by a mortise and tenon arrangement formed between said replaceable edge and said blade lower edge.

7. The improvement of claim 6, wherein said tenon is located on said lower edge of said blade and said tenon is located on and upper surface of said replaceable edge.

8. The improvement of claim 6, wherein said securing means is located in a heel section of said blade and said replaceable edge.

* * * * *